United States Patent [19]

Tardy

[11] Patent Number: 4,470,339

[45] Date of Patent: Sep. 11, 1984

[54] BRAKING VALVE FOR HYDRAULIC CIRCUITS

[75] Inventor: Maurice Tardy, Saint Etienne, France

[73] Assignee: Bennes Marrel, France

[21] Appl. No.: 554,374

[22] Filed: Nov. 23, 1983

Related U.S. Application Data

[63] Continuation of Ser. No. 258,085, Apr. 27, 1981.

[51] Int. Cl.[3] ..... F15B 13/04

[52] U.S. Cl. ..... 91/420; 91/445; 91/454; 251/63.4

[58] Field of Search ..... 91/420, 445, 454, 443, 91/447, 448; 251/63.4, 63.5

[56] References Cited

U.S. PATENT DOCUMENTS

| | | | |
|---|---|---|---|
| 3,792,715 | 2/1974 | Parrett et al. | 91/420 |
| 3,906,991 | 9/1975 | Häussler | 91/420 |
| 4,103,699 | 8/1978 | Vik | 91/420 |
| 4,194,436 | 3/1980 | Imada | 91/420 |
| 4,291,718 | 9/1981 | Sanin et al. | 91/420 |
| 4,323,095 | 4/1982 | Acerbi | 91/420 |
| 4,361,075 | 11/1982 | Block | 91/420 |

FOREIGN PATENT DOCUMENTS

| | | | |
|---|---|---|---|
| 2714410 | 10/1977 | Fed. Rep. of Germany | 251/63.4 |
| 723540 | 2/1955 | United Kingdom | 251/63.4 |

*Primary Examiner*—Robert E. Garrett
*Assistant Examiner*—Richard S. Meyer
*Attorney, Agent, or Firm*—Remy J. VanOphem

[57] ABSTRACT

The body of the braking valve includes a front chamber, an intermediate chamber and a rear chamber which surround a blocking component and a governing piston. The diameter of the bore, in which slides the governing piston at the rear of the chamber, is equal to the diameter of the line along which the truncated conical bearing surface of the blocking component comes into contact with a seat situated between the front and intermediate chambers. The pressure in the intermediate chamber is connected to an outlet of a distributor which has no effect on the balance position on the blocking component.

3 Claims, 6 Drawing Figures

BRAKING VALVE FOR HYDRAULIC CIRCUITS

This is a continuation of application Ser. No. 258,085, filed Apr. 27, 1981.

FIELD OF THE INVENTION

The present invention concerns an improved braking valve for hydraulic circuits.

BACKGROUND OF THE INVENTION

The use of braking valves is well known for controlling hydraulic components bearing heavy loads. These braking valves are designed so as to avoid a sudden and dangerous drop in the load lifted in the event of a break in a hydraulic oil carrying pipe.

Thus in the case of a double-acting hydraulic jack, a braking valve is connected in series a pipe which communicates with the main chamber of the jack when this main chamber is placed under pressure to raise the load. This braking valve is then governed by the pressure in the annular chamber of the jack, and the braking valve can only open in proportion with the degree to which the annular chamber is put under pressure. Each braking valve is generally mounted in parallel with a non-return valve which allows hydraulic fluid to pass only in the direction of the main chamber of the corresponding jack, assuming that the braking valve offers only a reduced section for the passage of the fluid even when fully open.

The known prior art braking valves may be used only with hydraulic circuits in "series distribution", that is to say, with hydraulic circuits including hydraulic distributors grouped together in a single assembly, the return circuit of each distributor being connected to the input circuit of the following distributor, and so on. The hydraulic circuits in "series distribution" present two major advantages.

First, certain interdependence of the different movements of a piece of equipment is obtained. This is advantageous, such as, in the case of a machine such as an excavator with a pivoted arm. As for example, it is advantageous when it is desired to work on any surface with a component placed at the free end of an arm with the pivoting of each arm component being controlled by a particular hydraulic jack.

Second, the use of a given valve as an output or pressure amplifier with regard to the following jack is allowed by varying the relative sections of the hydraulic jacks.

On the other hand the "series distribution" entails variations in pressure in the return circuits during the simultaneous operation of several distributors. There is the disadvantage that these pressure variations disturb the operation of the breaking valves.

The present invention has the aim of achieving a braking valve which may be used in hydraulic circuits in "series distribution" without experiencing the disadvantage of pressure variations.

The present invention also has the aim of achieving a braking valve which may be fitted directly on to the hydraulic jacks. The jacks are mounted in such a way that the connection of the hydraulic circuit between the braking valve and its hydraulic jack is direct and does not pass through any external piping which is prone to breaking or failure.

Finally, the present invention has the aim of achieving a breaking valve which allows a controlled descent of the load in the case of a break in the piping connected to the main chamber of a hydraulic jack.

A breaking valve according to the invention includes a seat situated in the body of the valve between a first chamber, or front chamber, connected to the inlet opening of a hydraulic component to be controlled, and a second chamber, or intermediate chamber, connected to an outlet of the distributor associated with the component.

A blocking component which is able to block the seat by moving forward, that is to say, in the direction of the first chamber.

A governing piston is disposed co-axial with the seat, and includes on the one hand a front cylindrical bearing surface mounted to slide in a first bore of the valve body, and on the other hand a rear cylindrical bearing surface mounted to slide in a second bore in the valve body, of greater diameter than the first bore, the first bore opening to the front into the second chamber, while the front end of the governing piston bears against the rear of the blocking component.

A third chamber, or rear chamber, of annular shape, is formed in the body of the valve in front of a shoulder of the governing piston located between the two cylindrical bearing surfaces thereof. This third chamber is connected to a governing circuit.

A calibrating spring is compressed against the rear of the governing piston so as to tend to permanently press the blocking component on the seat. Furthermore the contact between the blocking component and the seat takes place along a line which has the same diameter as the first bore, the longitudinal balance of the blocking component and the governing piston are thus independent of the pressure obtained in the second chamber, and depend only on the recall force of the calibrating spring, the force of pressure in the first chamber, and the force of pressure in the third chamber.

According to an additional characteristic of the invention, the valve body is made so as to bolt directly on to the body of a hydraulic jack, the first chamber communicating directly with the inlet opening of one of the chambers of the jack body.

According to an additional characteristic of the invention, the blocking component includes, at its front end, a cylindrical bearing surface mounted to slide, with little play, in a blind bore which opens into the first chamber, the cylindrical bearing surface forming a dampening chamber in the bottom of the blind bore to dampen the movements of the blocking component.

According to an additional characteristic of the invention, the valve in addition includes a non-return device integral with the body of the valve, and provided with a movable blocking component which allows the passage of fluid only from the intermediate chamber to the front chamber.

BRIEF DESCRIPTION OF THE DRAWINGS

The attached drawings, given by way of non-limiting example, will allow the invention to be better understood.

DESCRIPTION OF THE PREFERRED EMBODIMENT

Figure 1:
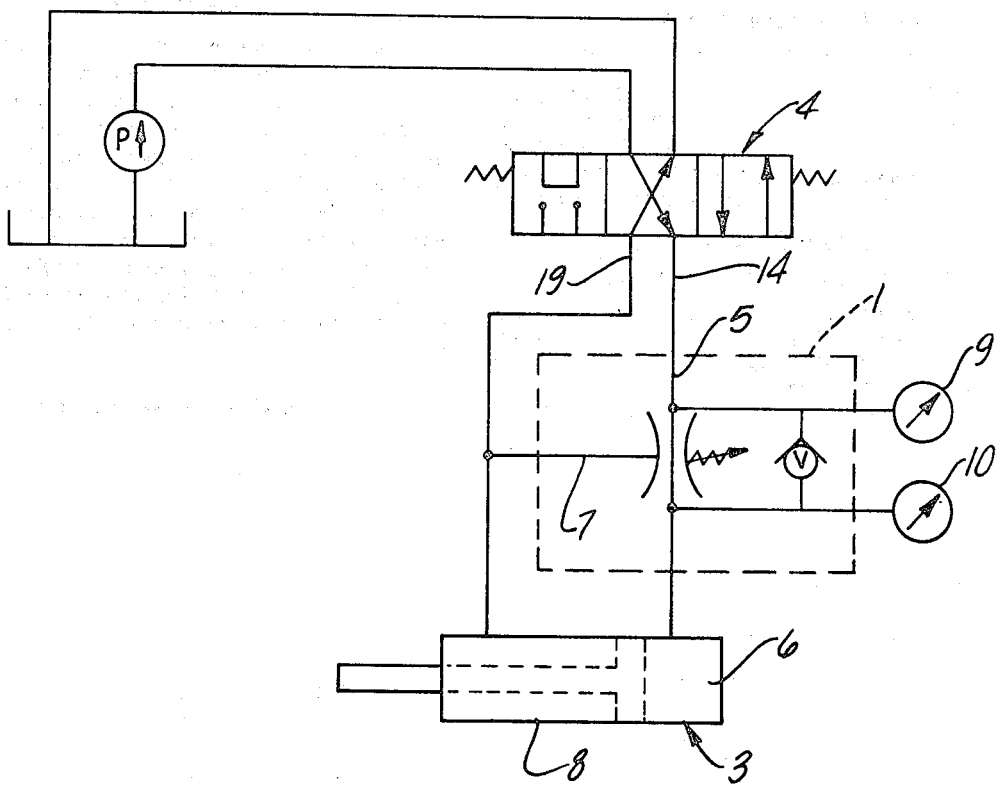
FIG. 1 is a schematic view showing the hydraulic diagram of a braking valve according to the present invention.

In FIG. 1, there is shown the hydraulic diagram of a braking valve 1 according to the invention. This diagram is conventional, given that the novelty of the invention lies in the practical construction of the braking valve itself.

The braking valve is mounted in parallel with a non-return valve 2 which is integral with the body of the valve.

A double-acting hydraulic jack 3 is controlled by means of a hydraulic distributor 4. The braking valve is connected in series in a channel 5 which communicates with a main chamber 6 of the jack 3, and is governed by means of a channel 7 connected to an annular chamber 8 of the jack 3. Pressure take-offs are provided to allow two pressure gauges 9 and 10 to be connected.

Figure 4:
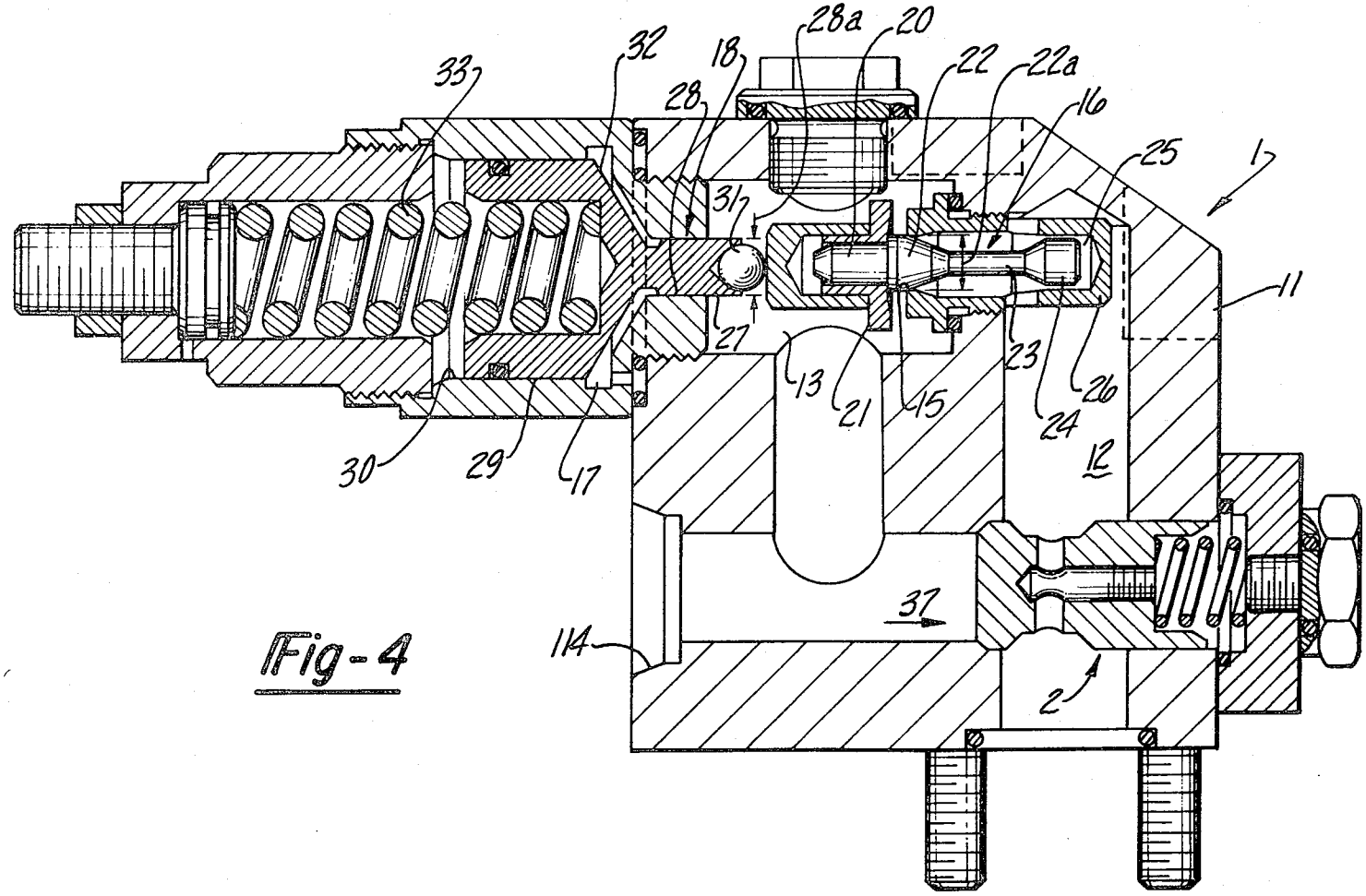
FIGS. 4 and 5 are sectional views taken along lines IV—IV of FIG. 3 illustrating the operation of this valve.
Figure 5:
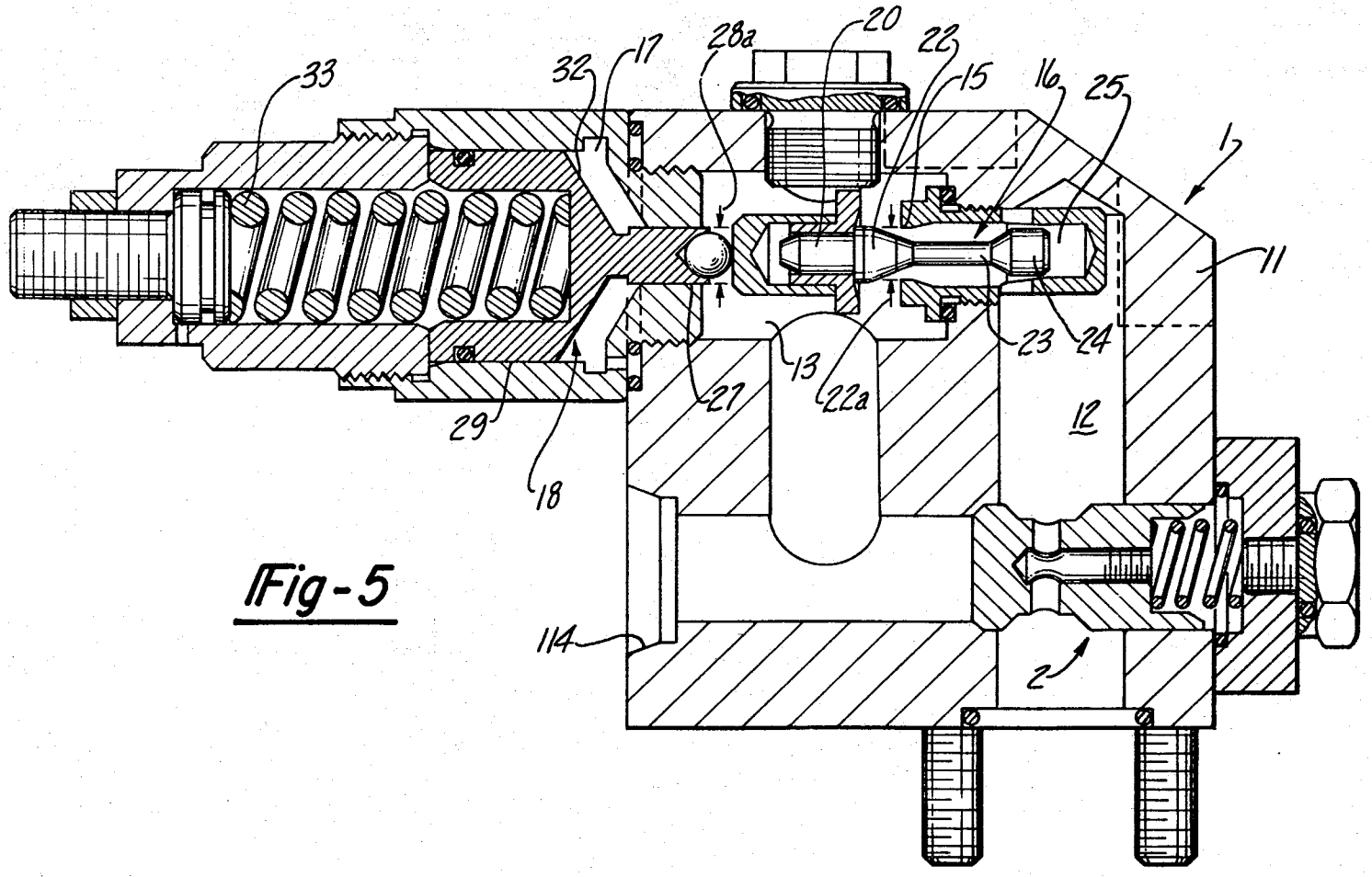

As shown in FIG. 4, there are three main chambers within the body 11 of the valve.

Figure 2:
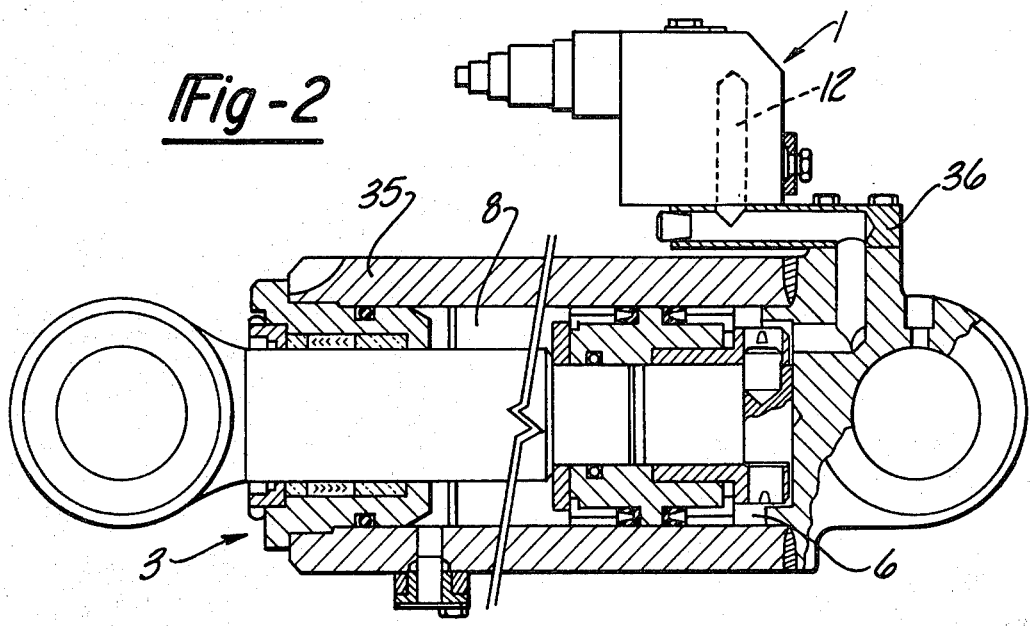
FIG. 2 is a longitudinal view, partly in axial section, of a hydraulic jack fitted with a braking valve according to the present invention.
Figure 3:
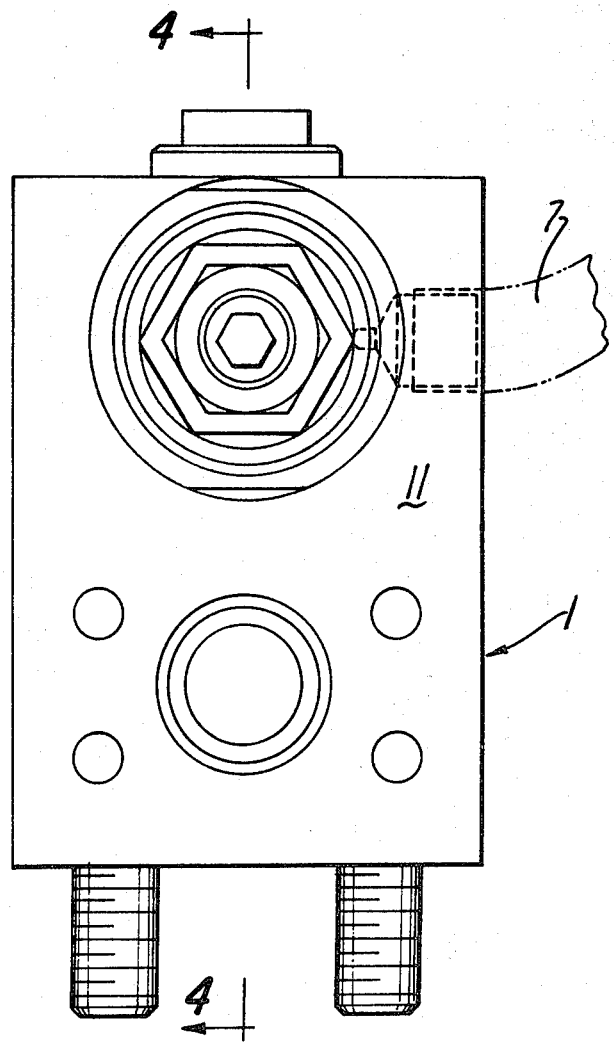
FIG. 3 is a side view of the braking valve of FIG. 2.

A front chamber 12 is connected to the inlet opening of the main chamber 6, shown in FIG. 2, of the jack 3.

An intermediate chamber 13 is connected to a first outlet line 14 of the distributor 4, shown in FIG. 1, and is separated from the front chamber 12 by a seat 15 co-operating with a blocking component 16.

Finally, a rear chamber 17 of annular shape is formed around a governing piston 18, and is connected to the governing channel 7, which is connected to a second outlet 19 of the distributor 4 (as shown in FIG. 1 ).

The blocking component 16 includes, from left to right as viewed in FIG. 4 a rear cylindrical bearing surface 20, a truncated conical bearing surface 22, a lengthened stem 23, and a front cylindrical bearing surface 24. The rear cylindrical bearing surface 20 is sleeved into a cap 21.

The truncated conical bearing surface 22 tapers towards the right, and completely blocks the seat 15 when the blocking component 16 is at its rightward most, full travel position.

The front cylindrical bearing surface 24 is mounted to slide with a small amount of play in a blind bore 25 which opens into the front chamber 12. The cylindrical bearing surface 24 thus forms in the bottom of the blind bore 25 a dampening chamber which allows the movements of the blocking component to be dampened.

It will be seen that in order to simplify machining, the blind bore 25 and the seat 15 are grouped in an attached cylinder 26.

The governing piston 18, which is co-axial with the seat 15, includes a front cylindrical bearing surface 27 mounted to slide in a first bore 28 in the body of the valve, and a rear cylindrical bearing surface 29 of greater diameter mounted to slide in a second bore 30 in the body of the valve. The first bore 28 opens towards the front into the intermediate chamber 13, while the front end of the governing piston 18 surrounds a ball 31 by means of which the governing piston bears against the rear of the cap 21. The rear chamber 17 is formed in front of a shoulder 32 of the governing piston 18. The shoulder 32 is located between the cylindrical bearing surfaces 27 and 29.

In the preferred arrangement, the diameter 28*a* of the bore 28 is precisely equal to the diameter along the line along which the 22*a* truncated conical bearing surface 22 comes into contact with the seat 15.

A calibrating spring 33 is compressed against the rear of the governing piston 18 so as to urge the blocking component 16 against the seat 15. A regulating screw 34 allows the compression of the spring 33 to be varied.

The non-return valve 2 integral with the body 11 of the valve 1 is of known construction, and is mounted so as to allow the circulation of hydraulic fluid only from the intermediate chamber 13 to the front chamber 12 as indicated by the arrow 37.

As best shown in FIG. 2, the body of the valve may be bolted either directly to the body 35 of the jack or to an adaptor-plate 36 which is bolted to the body 35. A flexible connecting channel is never used between the front chamber 12 of the braking valve and the main chamber 6 of the jack 3.

The operation of the breaking valve 1 is as follows:

To extend hydraulic the jack 3, the distributor 4 is operated in such a way as to pressurize the first outlet 14, and hence the intermediate chamber 13. The pressure causes the non-return valve 2 to open (arrow 37, FIG. 4), and the fluid flows into the main chamber 6 of the jack 3.

To retract the hydraulic jack 3, the distributor 4 is operated in such a way as to pressurize the second outlet 19, so as to supply fluid to the annular chamber 8 of the jack 3. This action simultaneously pressurizes the rear chamber 17 through the governing channel 7. Thus, while the blocking component 16 can only remain applied against the seat 15 when it is subject solely to the thrust force of the spring 33, the pressure in the rear chamber 17 acts on the shoulder 32 and allows the blocking component 16 to move rearwards under the action of the pressurized fluid in the front chamber 12. The rearward movement of the blocking component 16 allows the draining of the main chamber 6 of the jack 3 by means of the chambers 12 and 13 and the inlet 114 of the valve 1 and the line 14 of the distributor 4.

The essential advantage of the braking valve according to the invention lies in that, in view of the diameters 28*a* and 22*a* being equal, the longitudinal balance of the blocking component 16 and the governing piston 18 is totally independent of the pressure in the intermediate chamber 13, this balance depending only on;

the return force of the calibrating spring 33;

the force of the pressure exerted on the blocking component 16 in the front chamber 12; and the force of the pressure exerted on the governing piston 18 in the rear chamber 17.

In particular, in the case of hydraulic circuits in "series distribution", the variations in the output pressure of a distributor following in circuit cannot disturb the operation of distributors located earlier in circuit, and of corresponding dependent hydraulic components.

In addition, by an appropriate regulation of the calibrating spring 33, the braking valve 1 may be used simultaneously as an overload valve. In this case, if the pressure in the front chamber 12 becomes too great, the blocking component 16 can move back by compressing the spring 33 in the absence of any pressure in the rear chamber 17.

In order that the efficiency of the braking valve may be better understood, consideration will now be given to its method of operation in case of a breakage in the channel 5, which is the channel connecting the first outlet 14 of the distributor to the intermediate chamber 13 of the braking valve.

Assuming that this break occurs when the jack is loaded, but motionless, the jack maintains a load which tends, through its weight, to make the jack retract. In this case the rear chamber 17 is not under pressure and the spring 33 hence maintains the blocking component 16 against the seat 15, so that the valve remains closed. Thus, in spite of the intermediate chamber 13 being open to the air, the jack remains in position, the displacement of the blocking component 16 being conceivable only hypothetically if the pressure in the front chamber 12 exceeds the calibrated pressure of the valve, this hypothetical event is impossible in practice since the load could not previously have been lifted.

In a second case, assuming that the break in the channel 5 occurs during the retraction movement of the jack, this time, since the distributor 4 is supplying the annular chamber 8 of the jack, the rear chamber 17 is under pressure and the blocking component 16 remains away from the seat 15. Thus, the load continues to descend, but at a controlled speed and in proportion to the section available for passage of the fluid between the blocking component 16 and the seat 15. Naturally, the oil which leaves the main chamber 6 of the jack 3 cannot be recovered, and runs out at the point of breakage. During this movement, the driver is capable of stopping the contraction of the jack 3. In order to do this, it is sufficient for the driver to stop supplying the annular chamber 8 of the jack. Immediately, because of the fall in pressure in the rear chamber 17, the blocking component 16 is returned against the seat 15 by the spring 33.

Figure 6:
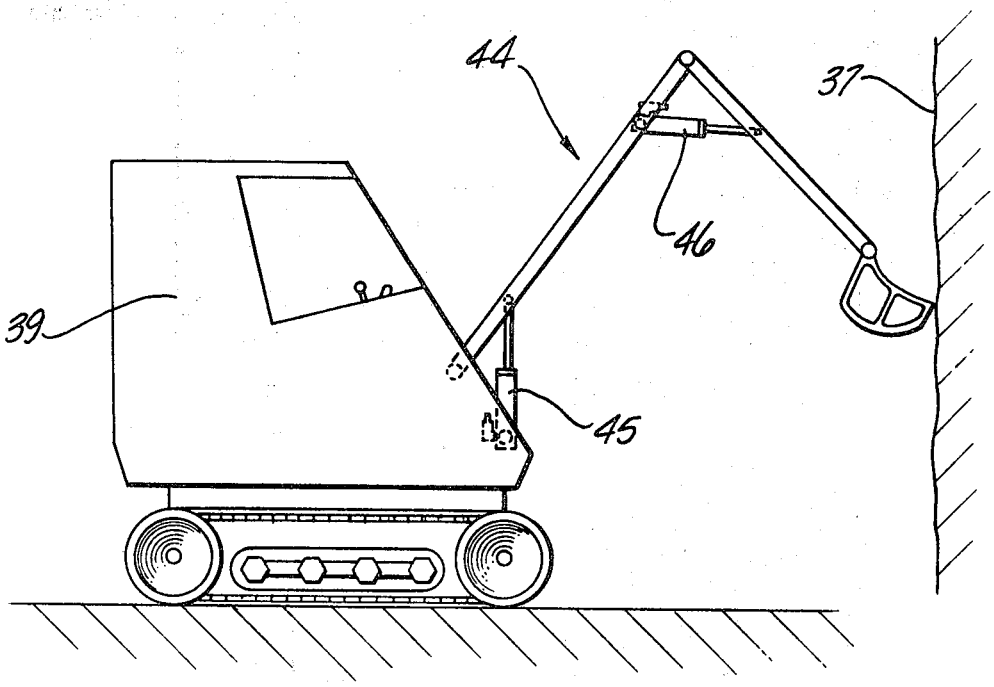
FIG. 6 shows an example of a machine using hydraulic jacks fitted with braking valves according to the invention.

Such a braking valve may be used with advantage on machines such as an excavator 34 (FIG. 6) having a pivoted arm 44 operable by jacks 45 and 46, given that a hydraulic circuit in "series distribution" is used in order to obtain a certain interdependence of the different movements. It may, for example, be desired to rake a surface 37 by means of a scoop 38 mounted at the free end of the arm, which entails complex simultaneous variations of the feed outputs of the jacks 45 and 46.

It will be seen that the braking valve according to the invention fully satisfies current regulations for the following reasons:

1. This valve is fitted on the jack itself (or to the jack base), and it is therefore capable of stopping any movement of the jack in question, even if this jack is under load, in the case of a breakage of a flexible connecting pipe. There is never any flexible connector between the jack and the braking valve; and 2. After a pipe breakage, the load previously lifted may still be brought gently to the ground by a controlled movement of the jack.

While the invention has been described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

What is claimed is:

1. A braking valve for installation between a pressure distributor means and a pressure responsive jack means, said pressure distributor means supplying pressurized fluid through a first outlet and a second outlet, said pressure responsive jack means having a first inlet interconnected with said first outlet of said pressure distributor means and further having a second inlet, said braking valve further comprising:

a valve body;

a first sealed chamber in said valve body;

a third outlet in said valve body from said first sealed chamber for interconnection with said second inlet of said pressure responsive jack means;

a second sealed chamber in said valve body;

a third inlet in said valve body to said second sealed chamber for interconnection with said second outlet of said pressure distributor means such that said second sealed chamber may be selectively pressurized;

first passage means in said valve body interconnecting said first sealed chamber and said second sealed chamber;

first valve seat means formed in said valve body adjacent said first passage means;

a first valve member movably interconnected with said valve body and selectively engageable with said first valve seat means to selectively open and close said first passage means for fluid flow between said first sealed chamber and said second sealed chamber;

first biasing means interposed said first valve member and said valve body and biasing said first valve member into engagement with said first valve seat means to close said first passage means, said first valve member being responsive to the pressure level in said second sealed chamber such that said pressure level in said second sealed chamber exerts a force on said first valve member biasing said first valve member away from said first valve seat means against the force of said first biasing means whereby said first passage means is selectively opened when said pressure level in said second sealed chamber exceeds a predetermined amount;

a third sealed chamber in said valve body, said second sealed chamber having at least one portion disposed between at least one portion of said first sealed chamber and at least one portion of said third sealed chamber;

a fourth inlet in said valve body to said third sealed chamber for interconnection with said first outlet of said pressure distributor means;

a first elongated passageway interconnecting said at least one portion of said first sealed chamber and said at least one portion of said second sealed chamber, said first elongated passageway having a longitudinal axis;

a second elongated passageway interconnecting said at least one portion of said second sealed chamber and said at least one portion of said third sealed chamber, said second elongated passageway being axially aligned with said first elongated passageway, said second elongated passageway having a minimal cross-sectional diameter measurement indentical to the minimal cross-sectional diameter measurement of said first elongated passageway;

a second valve seat means formed in said valve body adjacent said first elongated passageway;

piston means movably disposed in said third sealed chamber, said piston means having a first surface exposed to the pressure in said third sealed chamber, said first surface facing in the direction towards said second sealed chamber such that said pressure in said third sealed chamber exerts a first force on said piston means in a first predetermined direction along said longitudinal axis, said first predetermined direction being the direction from said second sealed chamber towards said third sealed chamber, said piston means further having a reduced diameter portion at least partially slidingly and sealingly disposed in said second elongated passageway;

a second valve member at least partially disposed in said second sealed chamber, said second valve member being movably interconnected with said valve body such as to be selectively displaceable along said longitudinal axis towards and away from said second valve seat means, said second valve member having a first end selectively engageable with said reduced diameter portion of said piston means, a second end opposite said first end, and a valving portion remote from said first end selectively engageable with said second valve seat means to open and close said first elongated passageway such as to selectively permit fluid flow therealong between said first sealed chamber and said second sealed chamber, said second valve member experiencing a second force on said second end from the pressure level in said first sealed chamber, said second force being in said first predetermined direction such that said second force biases said first end of said second valve member against said reduced diameter portion of said piston means; and second biasing means interposed said valve body and said piston means, said second biasing means biasing said piston means in a second predetermined direction along said lonitudinal axis opposite said first predetermined direction such as to exert a third force on said piston means, such that, said second valve member is selectively displaced along said longitudinal axis to open and close said first elongated passageway in response to a net force equal to the sum of said first, second and third forces, the movement of said second valve member being independent of the pressure level in said second sealed chamber.

2. The braking valve of claim 1 wherein said valve body is rigidly interconnected with said pressure responsive jack means.

3. The braking valve of claim 1 wherein:

said valve body further comprises cylinder means interposed said first sealed chamber and said second sealed chamber;

said first elongated passageway comprises a passageway through said cylinder means;

said second valve seat means is formed at one end of said cylinder means; and said second valve member comprises secondary piston means extending from said valving portion, said secondary piston means being movably disposed in said cylinder means such that said cylinder means provides a dampening of undesired rapid oscillation of said second valve member.

* * * * *

UNITED STATES PATENT AND TRADEMARK OFFICE

CERTIFICATE OF CORRECTION

PATENT NO. : 4,470,339

DATED : September 11, 1984

INVENTOR(S) : Maurice Tardy

It is certified that error appears in the above-identified patent and that said Letters Patent is hereby corrected as shown below:

Column 1, line 18, after "series" insert ---- to ----.

Column 1, preceding line 55, insert the subtitle ---- SUMMARY OF THE INVENTION ----.

Column 2, line 10, after "component" insert ---- is provided ----.

Column 4, line 2, after "diameter" insert ---- 22a ----.

Column 4, line 3, delete "22a" .

Column 4, line 15, after "jack" insert ---- 3 ---.

Signed and Sealed this

*Seventh* Day of *May 1985*

[SEAL]

*Attest:*

DONALD J. QUIGG

*Attesting Officer*

*Acting Commissioner of Patents and Trademarks*